US006387873B1

(12) United States Patent
Carter et al.

(10) Patent No.: US 6,387,873 B1
(45) Date of Patent: May 14, 2002

(54) DETERGENT COMPOSITION WITH IMPROVED CALCIUM SEQUESTRATION CAPACITY

(75) Inventors: John David Carter, Newcastle-Upon-Tyne (GB); Eugene Joseph Pancheri, Montgomery; Robert Henry Rohrbaugh, Indian Springs, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/821,375

(22) Filed: Mar. 29, 2001

Related U.S. Application Data

(60) Provisional application No. 60/194,721, filed on Apr. 5, 2000.

(51) Int. Cl.[7] ..... C11D 3/02

(52) U.S. Cl. ..... 510/507; 510/323; 510/443; 510/444; 510/445; 510/446; 510/507; 510/531; 510/532

(58) Field of Search ..... 510/323, 443, 510/444, 445, 446, 507, 531, 532

(56) References Cited

U.S. PATENT DOCUMENTS

| | | | | |
|---|---|---|---|---|
| 4,303,629 A | | 12/1981 | Strack et al. | 423/329 |
| 4,405,484 A | | 9/1983 | Miyazaki et al. | 252/174.25 |
| 5,944,933 A | * | 8/1999 | Heller et al. | 156/276 |

FOREIGN PATENT DOCUMENTS

| | | |
|---|---|---|
| DE | 27 53 477 A1 | 6/1979 |
| EP | 0 050 897 A1 | 5/1982 |

* cited by examiner

*Primary Examiner*—Charles Boyer
(74) *Attorney, Agent, or Firm*—Marianne Dressman; Kim William Zerby; Steven W. Miller

(57) ABSTRACT

This invention relates to detergent compositions having significantly improved calcium sequestration capacity as well as superior builder capacity in comparison to conventional aluminosilicate builder materials, while not redepositing on fabrics. More particularly, this invention relates to detergent compositions comprising microclusters of submicron crystallites of an aluminosilicate ion exchange material.

21 Claims, 4 Drawing Sheets

Scanning Electron Micrograph of microclusters according to the present invention.

PRIOR ART
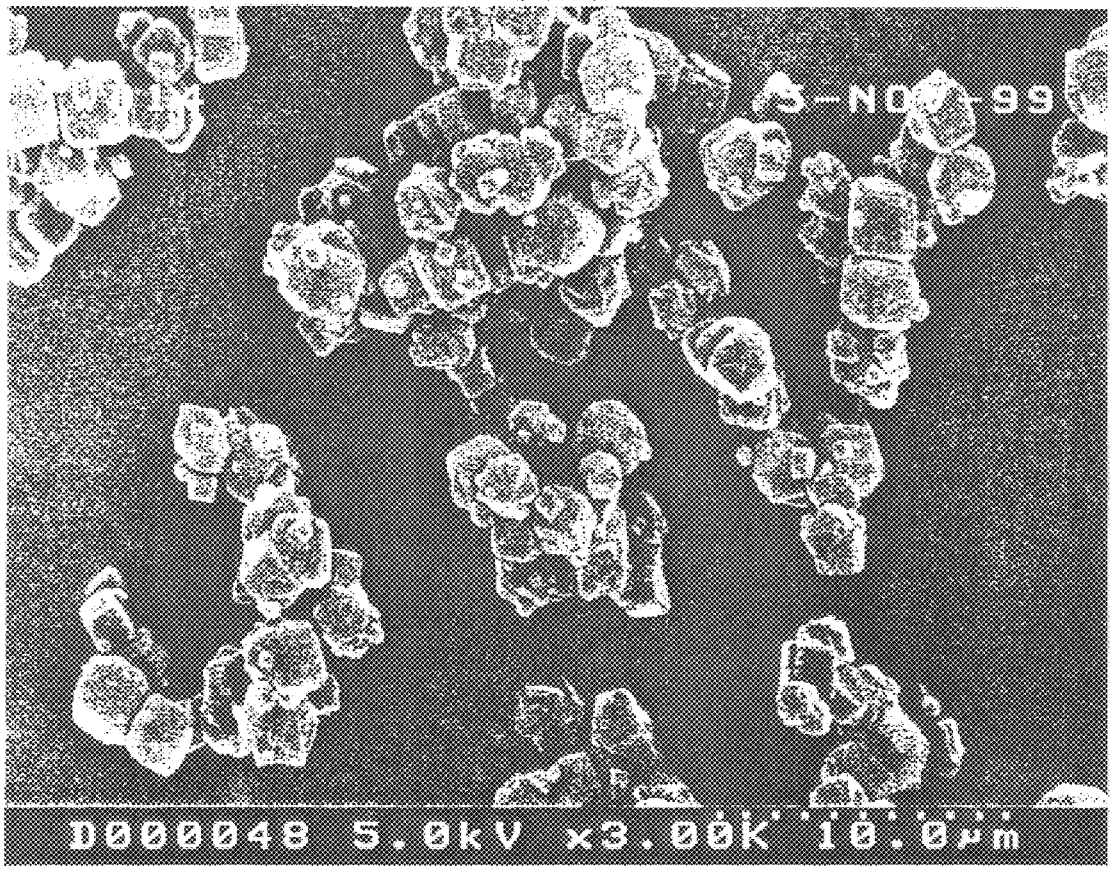
Figure 1. Scanning Electron Micrograph of Commercially available Zeolite A

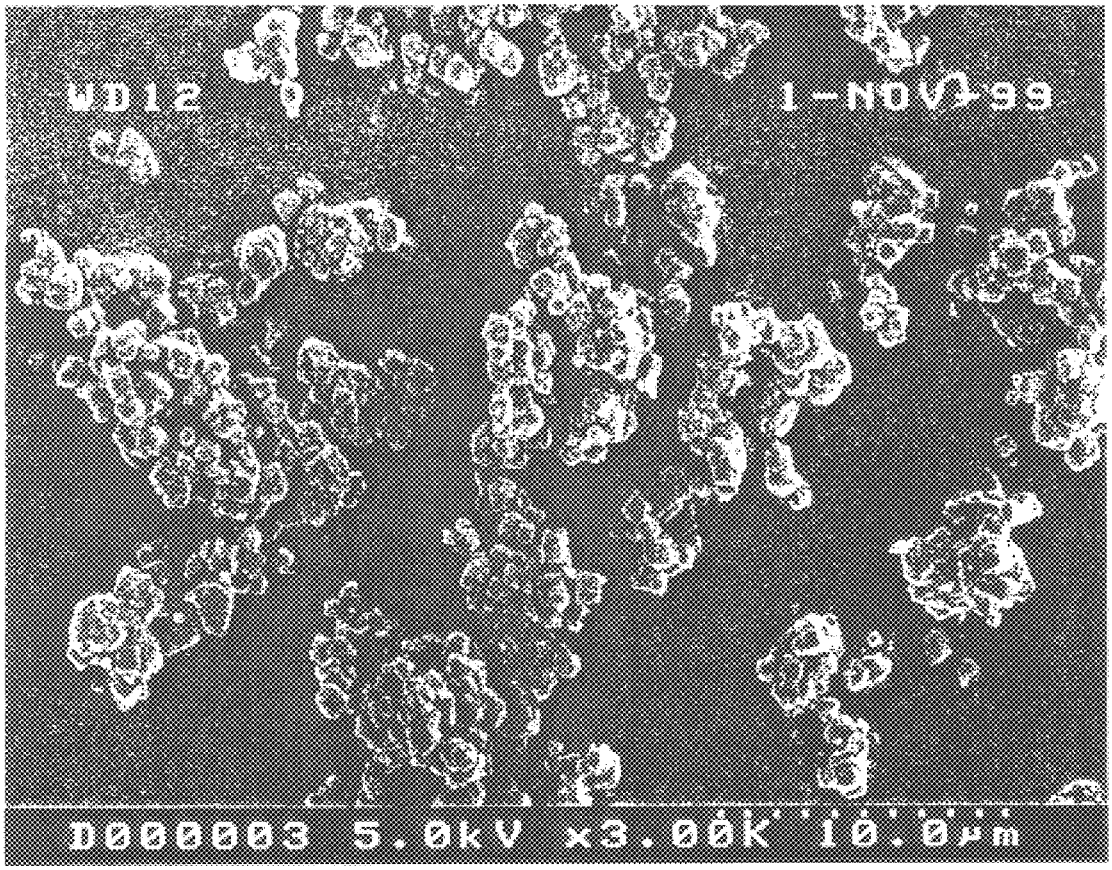
Figure 2. Scanning Electron Micrograph of microclusters according to the present invention.

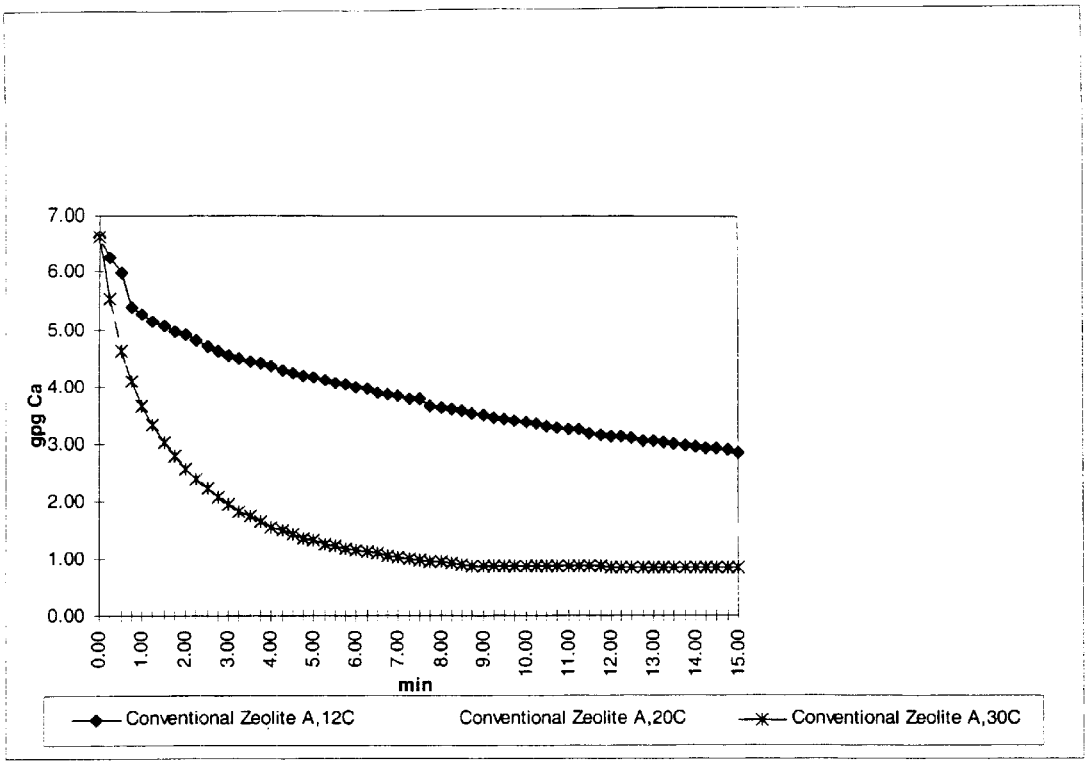
Figure 3. Calcium Sequestration Efficiency Curve of Conventional Zeolite A

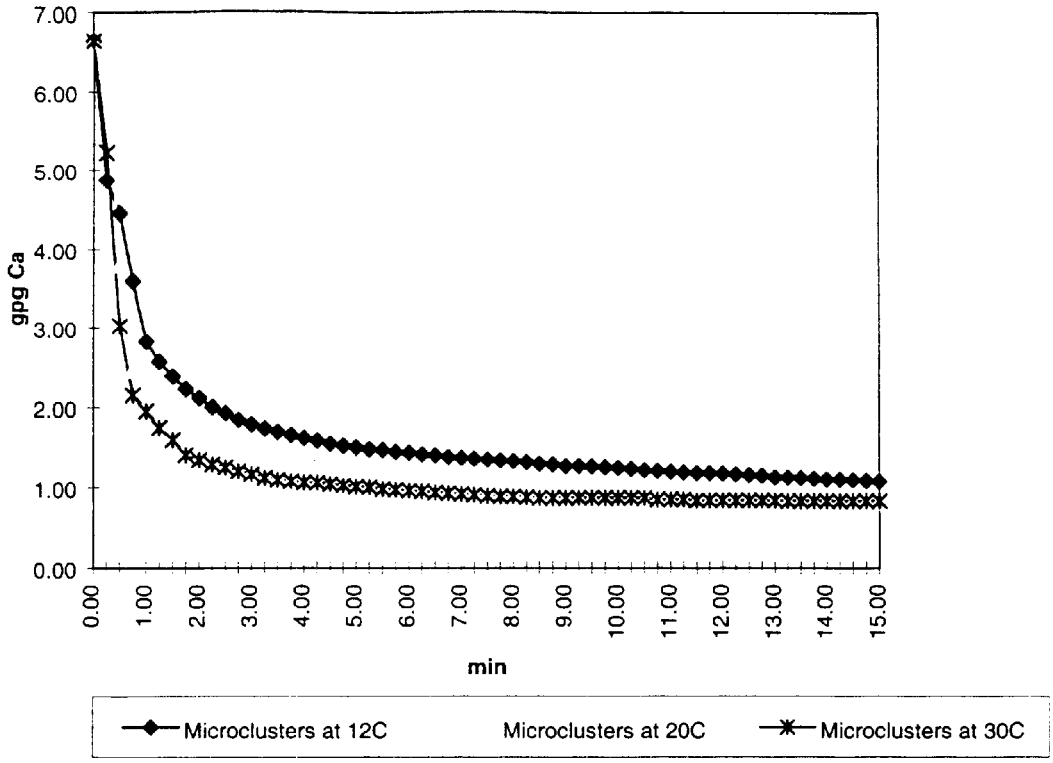
Figure 4. Calcium Sequestration Efficiency Curve of Microclusters

DETERGENT COMPOSITION WITH IMPROVED CALCIUM SEQUESTRATION CAPACITY

CROSS REFERENCE TO RELATED APPLICATIONS

This application claims priority under 35 U.S.C. § 119(e) to U.S. Provisional Application Serial No. 60/194,721, filed Apr. 5, 2000.

FIELD OF THE INVENTION

This invention relates to detergent compositions having significantly improved calcium sequestration capacity as well as superior builder capacity in comparison to conventional aluminosilicate builder materials, while not redepositing on fabrics. More particularly, this invention relates to detergent compositions comprising microclusters of submicron crystallites of an aluminosilicate ion exchange material.

BACKGROUND OF THE INVENTION

The presence of hardness ions (i.e. $Ca^{+2}$, $Mg^{+2}$) during the laundering process has long been recognized to negatively impact the cleaning performance of detergents. It is also known that faster sequestration of calcium and magnesium yields improved cleaning performance.

The primary function of inorganic builders such as zeolites in detergents is to remove hardness ions in the wash water via ion-exchange processes and thus improve the cleaning performance of the detergent. For a zeolite to be an effective builder the ion exchange must take place within the relatively short time frame of a wash cycle, typically 10–12 minutes. More importantly the hardness level must be reduced in the first 0–5 minutes to significantly improve the cleaning performance of the detergent composition.

Despite the long history of zeolite A and the more recent development of relatively costly alternatives such as zeolite AX, the current zeolite builder systems remain deficient in their ability to efficiently sequester large enough volumes of hardness ions in a relatively short period of time (i.e. 0–5 minutes). This is a result of the fact that the diffusional paths of hardness ions within currently available zeolite crystals are too long. Under actual wash conditions, wherein the wash solution is between 20° C.–40° C., equilibrium times for calcium exchange are typically much greater than five minutes for commercially available zeolite A. At lower temperatures (<20° C.) the rate of ion exchange is slowed even further, such that the calcium level never equilibrates in the time frame of a typical wash cycle.

Many attempts have been made in the art to solve the problems described above. Attempts have been made at using small particle size zeolite A. However, this approach introduced new problems. When conventional zeolite A particles are simply ground up into smaller particles they exhibit slightly improved kinetics under typical wash conditions. However, the small particles deposit on the surface of fabrics and because of their small size are not removed by the washing process. After a number of wash cycles this leads to an undesirable white buildup on fabrics. Additionally, these small particle size zeolites do not provide improved kinetics in stressed wash conditions with temperatures below 25° C. and high water hardness.

Accordingly the need remains for an inorganic builder/zeolite material that provides rapid reduction in the level of free hardness in the wash water, most preferably in the first 2–3 minutes of the wash cycle. There is also a need for an inorganic builder/zeolite material capable of delivering improved hardness ion sequestration capacity, low redeposition and superior builder capacity, especially at low temperatures. These new materials must also remain compatible with existing process techniques and safety/handling issues.

Additionally, the need also exists for a zeolite material which simultaneously embodies the low redeposition property of conventional large particle size zeolite A and the improved kinetics and builder capacity of small particle size zeolites. These problems are solved by the present invention.

SUMMARY OF THE INVENTION

The present invention meets the aforementioned needs by providing a detergent composition with superior hardness ion sequestration capacity while maintaining or improving cleaning performance, especially at low temperatures. This is achieved by providing a detergent composition comprising microclusters of an aluminosilicate ion exchange material. According to a first embodiment of the present invention a detergent composition comprises a detersive surfactant system, a zeolite system comprising microclusters of submicron crystallites of an aluminosilicate ion exchange material selected from the group consisting of zeolite A, zeolite X, zeolite Y, chabazite and mixtures thereof and conventional aluminiosilicate materials other than those comprising the microclusters and detergent adjunct materials, including but not limited to conventional builders, chelants, brighteners, bleaching agents, enzymes, soil release polymers, dye transfer inhibitors, fillers, perfumes, and mixtures thereof. Preferably the detersive surfactant system is present at about 0.1% to about 95% by weight of the total composition and the total zeolite system is present at about 5% to about 75% by weight of the total composition, the balance being one or more detergent adjuncts. The zeolite system comprises from about 25% to about 100%, preferably from about 50% to about 100%, microclusters according to the present invention and from about 0% to about 75%, preferably from about 0% to about 50%, conventional aluminosilicate materials other than those comprising the microclusters.

The present invention also provides a method for sequestering hardness ions in wash water at significantly increased speed. The method comprises the step of preparing a detergent composition containing microclusters of submicron crystallites of an aluminosilicate ion exchange material selected from the group consisting of zeolite A, zeolite X, zeolite Y, chabazite and mixtures thereof, and contacting said detergent composition with clothes.

All percentages, ratios, and proportions herein are on a weight basis unless otherwise indicated. All documents cited are hereby incorporated by reference in their entirety.

BRIEF DESCRIPTION OF THE DRAWINGS

FIG. 1. is a scanning electron micrograph of commercially available conventional zeolite A particles of the prior art at 3000×magnification.

FIG. 2. is a scanning electron micrograph of microclusters of submicron crystallites of an aluminosilicate ion exchange material according to the present invention at 3000× magnification.

FIG. 3. is a graph illustrating the calcium sequestration efficiency of conventional zeolite A particles of the prior art at various temperatures.

FIG. 4. is a graph illustrating the calcium sequestration efficiency of microclusters according to the present invention at various temperatures.

DETAILED DESCRIPTION OF THE INVENTION

The present invention relates to detergent compositions comprising microclusters of an aluminosilicate ion exchange material selected from the group consisting of zeolite A, zeolite X, zeolite Y, chabazite and mixtures thereof (hereinafter referred to as microclusters). The microclusters provide significantly improved hardness ion sequestration capacity and efficiency when used in detergent compositions. Additionally, the sequestration capacity of detergent compositions comprising the microclusters is not temperature limited. The microclusters surprisingly provide significantly improved sequestration of hardness ions in water temperatures below 25° C. as compared to conventional zeolite A materials.

While not wishing to be bound by theory, it is believed that by aggregating submicron crystallites of an aluminosilicate ion exchange material, the beneficial properties of both large and small particle size zeolites are achieved. The individual crystallites that are aggregated to form the microclusters of the present invention are about one fifth to one tenth the size of conventional zeolite crystallites. Therefore, it is believed that the migration distance of the hardness ions in the crystallites is proportionately shorter resulting in faster ion exchange and faster time to equilibration. This benefit is achieved even though the submicron crystallites are aggregated resulting in an overall particle size similar to that of conventional zeolite particles such as zeolite A. This is surprising since the distance the hardness ions must travel through the wash solution to get to the nearest microcluster is about the same as the distance the ions must travel to reach conventional zeolite particles.

Although the kinetics of detergent compositions comprising the aforementioned microclusters is so dramatically improved, one might expect that the improvement would be less significant in stressed wash conditions. Stressed wash conditions include solution temperatures less than or equal to 20° C. and at least 8 gpg hardness. At lower temperatures (<20° C.) the rate of ion exchange is usually significantly slower than at temperatures >20° C. Surprisingly, detergent compositions comprising microclusters according to the present invention exhibit the same or better kinetics in stressed wash conditions.

It has been observed that the presence of magnesium ions in the wash water has a detrimental effect on calcium sequestration rates. At low temperatures, <25° C., it is believed that the pores of conventional zeolite particles constrict just enough to prevent calcium ions from entering. It is believed that by providing submicron crystallites there are more accessible pores, such that calcium sequestration is not negatively affected by the presence of magnesium ions.

In addition to providing improved kinetics, the microclusters of the present invention provide improved builder capacity and low redeposition on fabrics. One would expect crystallites less than 1 micron in size to redeposit on fabrics like clay and other small particle size zeolites have been shown to do. It is believed that when very small particles deposit on fabrics during the wash they are trapped because the force adhering them to the fabrics is greater than the force of the wash water flowing against the fabrics. The microclusters, while being composed of submicron crystallites, also have the properties of larger size crystallites such that when deposited on clothes they are able to be rinsed away, thus solving the redeposition problems previously encountered when using small particle size zeolites.

Further, the higher surface area of the microclusters results in process advantages as well. For example, surfactant loading can potentially be increased two-fold without negatively impacting product flow attributes. This is surprising because such a substantial increase in surfactant loading into conventional zeolite particles leads to stickiness and clumping of the composition.

Zeolites are commonly used as substitutes for phosphate builders which allegedly can have an adverse impact on the environment. However, where the use of phosphate is still permitted they are the builder of choice due to their superior building capacity and low cost in comparison to zeolite alternatives. The microclusters described herein provide at least comparable builder capacity to phosphates. Therefore, the improved builder capacity of the microclusters described herein allow the detergent formulator the option of replacing phosphate builders which allegedly pose a danger to the environment with a more environmentally friendly builder while maintaining or improving cleaning performance.

MICROCLUSTERS

The microclusters of the present invention are comprised of submicron crystallites of an aluminosilicate ion exchange material selected from the group consisting of zeolite A, zeolite X, zeolite Y, chabazite and mixtures thereof. The submicron crystallites have an average particle size of from about 0.05 $\mu$M to about 1.0 $\mu$M, preferably from about 0.1 $\mu$M to about 0.8 $\mu$M and most preferably from about 0.05 $\mu$M to about 0.5 $\mu$M, as visually determined by scanning electron microscopy.

The submicron crystallites described above are aggregated to form microclusters, wherein the total size of the microcluster is from about 1.0 $\mu$M to about 7.0 $\mu$M preferably from about 2 $\mu$M to about 5 $\mu$M, as determined by standard BET method. Although the overall size of the microclusters is similar to that of conventional zeolite A particles, as determined by standard BET method, the small size of the submicron crystallites provides for an ion exchange accessible surface area of from about 5 $m^2/g$ to about 50 $m^2/g$, preferably from about 20 $m^2/g$ to about 30 $m^2/g$. This is approximately ten times the surface area of conventional zeolite A particles. Additionally, by providing microclusters comprised of submicron crystallites, not only is surface area increased but the diffusional path of the hardness ions within the microclusters is decreased by an order of magnitude. This results in significantly greater speed to equilibration.

Microclusters according to the present invention can be prepared in similar fashion to commercial zeolite A materials such as Valfor 100. Microclusters according to the present invention can be prepared from conventional sources of silica, alumina and alkali. For example, clear aluminosilicate gels of the type $Al_2O_3$—$SiO_2$—$Na_2O$—$H_2O$ are formed via combining sodium aluminate and sodium silicate under strongly alkaline conditions. In the presence of high concentrations of inorganic electrolyte such as sodium chloride or sodium carbonate, the gels are aged at 50° C.–95° C. (in a constant temperature bath) for 0.1–12 hrs. The resulting material is filtered, thoroughly washed with water and oven dried to the required hydration level, typically 15–25% by weight. Powder XRD pattern of the isolated microclusters is characteristic of highly crystalline zeolite A. Depending on the specific preparation to be used, electrolyte level, alkalinity, temperature and crystallization times can all be adjusted to achieve the desired crystallite and microcluster particle size.

Microclusters according to the present invention are incorporated into detergent compositions as part of a total zeolite system. The zeolite system is from about 5% to about 75% of the total detergent composition. The zeolite system comprises from about 25% to about 100%, preferably from about 50% to about 100%, microclusters according to the present invention and from about 0% to about 75%, preferably from about 0% to about 50%, conventional aluminosilicate materials other than those comprising the microclusters. The conventional aluminosilicate materials are selected from the group consisting of sodalite, hydroxysodalite, zeolite P, up to maximum aluminum type P and mixtures thereof.

MORPHOLOGY

As can be seen in FIG. 1 and FIG. 2 there is a dramatic difference in available surface between conventional zeolite A particles of the prior art (See FIG. 1.) and the microclusters (See FIG. 2.) of the present invention. The surprising increase in hardness ion sequestration at low wash solution temperatures is illustrated by comparing FIGS. 3 and 4.

KINETICS

In order to assess the relative sequestration capacity of microclusters according to the present invention, compared with conventional zeolite type A, in mixtures resembling wash water, sequestration tests are conducted in mixed calcium/magnesium solutions at 10° C.–30° C. and pH 10. 250 ml aliquots of 0.964 mmol calcium plus magnesium solutions are buffered with glycine solutions to a pH of 10. The Ca:Mg molar ratio is established at 4:1. The test hardness solutions are adjusted to the required temperature in a jacketed beaker to which 375 ppm charges of air-equilibrated microclusters or reference builders are added to the test mixtures and stirred on a PMC Dataplate Series 730 with a 25.4 mm×9.5 mm stir bar at a rate of 500 rpm. Calcium hardness concentration is monitored by an Orion Model 9320BN calcium selective electrode and an Orion Model 900011 reference electrode connected to an Orion Model 290A pH/ISE meter. Calcium removal at 15 sec. intervals is recorded and plotted over a span of 15 minutes. Kinetic differences are noted during the first 2 minutes while equilibrium is noted at the 15 min. time period.

The improvement in hardness ion sequestration rate for detergent compositions comprising the microclusters is not temperature dependent. The hardness sequestration rate changes very little relative to the temperature of the wash solution. However, the hardness ion sequestration rate of conventional zeolite builders changes quite significantly based on temperature changes. Conventional zeolite builders sequester fewer hardness ions as the temperature of the wash solution is lowered.

The performance of the microclusters as well as reference materials are subjected to this test and the results are summarized below in Table 1.

Table 1. Calcium sequestration rates of conventional zeolite A compared to microclusters according to the present invention.

| Time | Conventional Zeolite, A 12° C. | Microclusters at 12° C. | Conventional Zeolite A, 20° C. | Microclusters at 20° C. | Conventional Zeolite A 30° C. | Microclusters at 30° C. |
|---|---|---|---|---|---|---|
| 0.00 | 6.64 | 6.64 | 6.64 | 6.64 | 6.64 | 6.64 |
| 0.50 | 5.98 | 4.45 | 4.84 | 3.80 | 4.63 | 3.03 |

-continued

| Time | Conventional Zeolite, A 12° C. | Microclusters at 12° C. | Conventional Zeolite A, 20° C. | Microclusters at 20° C. | Conventional Zeolite A 30° C. | Microclusters at 30° C. |
|---|---|---|---|---|---|---|
| 1.00 | 5.27 | 2.83 | 4.33 | 2.02 | 3.67 | 1.96 |
| 1.50 | 5.07 | 2.39 | 3.84 | 1.64 | 3.04 | 1.60 |
| 2.00 | 4.92 | 2.12 | 3.52 | 1.40 | 2.58 | 1.35 |
| 2.50 | 4.71 | 1.94 | 3.28 | 1.28 | 2.24 | 1.25 |
| 3.00 | 4.57 | 1.80 | 3.04 | 1.19 | 1.96 | 1.17 |
| 3.50 | 4.47 | 1.70 | 2.86 | 1.14 | 1.74 | 1.10 |
| 4.00 | 4.37 | 1.63 | 2.70 | 1.09 | 1.56 | 1.07 |
| 4.50 | 4.24 | 1.55 | 2.54 | 1.05 | 1.43 | 1.05 |
| 5.00 | 4.18 | 1.51 | 2.39 | 1.01 | 1.32 | 1.01 |
| 5.50 | 4.08 | 1.47 | 2.25 | 0.99 | 1.22 | 0.98 |
| 6.00 | 3.99 | 1.44 | 2.14 | 0.97 | 1.14 | 0.96 |
| 6.50 | 3.90 | 1.41 | 2.06 | 0.95 | 1.08 | 0.94 |
| 7.00 | 3.85 | 1.38 | 1.94 | 0.93 | 1.02 | 0.92 |
| 7.50 | 3.79 | 1.36 | 1.87 | 0.92 | 0.97 | 0.90 |
| 8.00 | 3.65 | 1.34 | 1.83 | 0.91 | 0.93 | 0.89 |
| 8.50 | 3.60 | 1.31 | 1.79 | 0.89 | 0.88 | 0.87 |
| 9.00 | 3.52 | 1.28 | 1.75 | 0.88 | 0.87 | 0.87 |
| 9.50 | 3.44 | 1.27 | 1.71 | 0.87 | 0.87 | 0.87 |
| 10.00 | 3.39 | 1.25 | 1.68 | 0.85 | 0.86 | 0.87 |
| 10.50 | 3.31 | 1.22 | 1.66 | 0.85 | 0.86 | 0.87 |
| 11.00 | 3.26 | 1.20 | 1.62 | 0.84 | 0.86 | 0.85 |
| 11.50 | 3.19 | 1.18 | 1.60 | 0.84 | 0.86 | 0.84 |
| 12.00 | 3.14 | 1.18 | 1.57 | 0.83 | 0.85 | 0.84 |
| 12.50 | 3.10 | 1.16 | 1.54 | 0.83 | 0.85 | 0.84 |
| 13.00 | 3.05 | 1.13 | 1.54 | 0.83 | 0.85 | 0.84 |
| 13.50 | 3.00 | 1.12 | 1.53 | 0.82 | 0.84 | 0.83 |
| 14.00 | 2.96 | 1.11 | 1.52 | 0.82 | 0.84 | 0.83 |
| 14.50 | 2.92 | 1.10 | 1.51 | 0.82 | 0.84 | 0.83 |
| 15.00 | 2.85 | 1.08 | 1.51 | 0.82 | 0.84 | 0.83 |

DETERGENT COMPOSITIONS

The microclusters as described herein are incorporated into detergent compositions including but not limited to granular laundry and/or dish detergent compositions, detergent tablets and detergent bars. Such microclusters may also be incorporated in liquid detergent compositions. Preferred detergent compositions will be formulated such that, during use in aqueous cleaning operations, the wash water will have a pH of between about 6.5 and about 11, preferably between about 7.0 and 10.5, more preferably between about 7.0 to about 9.5. Techniques for controlling pH at recommended usage levels include the use of buffers, alkalis, acids, etc., and are well known to those skilled in the art.

Compositions herein can vary in physical form, including but not limited to granular, tablet, bar, and pouch forms. The compositions include the so-called concentrated granular detergent compositions adapted to be added to a washing machine by means of a dispensing device placed in the machine drum with the soiled fabric load.

The mean particle size of the components of granular detergent compositions herein, is preferably such that no more than about 5% of particles are greater than about 1.7 mm in diameter and not more than about 5% of particles are less than about 0.15 mm in diameter. "Mean particle size" herein can be determined by sieving a sample of material to be sized into a number of fractions (typically 5) on a series of Tyler sieves. Weights of fractions are plotted against the aperture size of the sieves. The mean particle size is the aperture size through which 50% by weight of the sample would pass.

Granular detergent compositions in accordance with the present invention can be either high-density types, now common in the marketplace; typically these have a bulk density of at least 550 g/liter, more preferably from 650 g/liter to 1200 g/liter or "fluffy" types with densities between 200 g/liter–550 g/liter.

Optional Detersive Ingredients

As a preferred embodiment, the conventional detergent ingredients are selected from typical detergent composition components such as detersive surfactants and detersive builders. Optionally, the detergent ingredients can include one or more other detersive adjuncts or other materials for assisting or enhancing cleaning performance, treatment of the substrate to be cleaned, or to modify the aesthetics of the detergent composition. Usual detersive adjuncts of detergent compositions include the ingredients set forth in U.S. Pat. No. 3,936,537, Baskerville et al. and in Great Britain Patent Application No. 9705617.0, Trinh et al., published Sep. 24, 1997. Such adjuncts are included in detergent compositions at their conventional art-established levels of use, generally from 0% to about 80% of the detergent ingredients, preferably from about 0.5% to about 20% and can include color speckles, suds boosters, suds suppressors, antitarnish and/or anticorrosion agents, soil-suspending agents, soil release agents, dyes, fillers, optical brighteners, germicides, alkalinity sources, hydrotropes, antioxidants, enzymes, enzyme stabilizing agents, solvents, solubilizing agents, chelating agents, clay soil removal/anti-redeposition agents, polymeric dispersing agents, processing aids, fabric softening components, static control agents, bleaching agents, bleaching activators, bleach stabilizers, etc.

Surfactants

The hand and/or machine washing detergent compositions of the present invention may optionally comprise a non mid-chain branched alkyl sulfate or non-mid chain branched aryl sulphonate surfactant. Depending upon the embodiment of the present invention one or more categories of surfactants may be chosen by the formulator. Preferred categories of surfactants are selected from the group consisting of anionic, cationic, nonionic, zwitterionic, ampholytic surfactants, and mixtures thereof. Within each category of surfactant, more than one type of surfactant of surfactant can be selected. For example, preferably the solid (i.e. granular) and viscous semi-solid (i.e. gelatinous, pastes, etc.) systems of the present invention, surfactant is preferably present to the extent of from about 0.1% to 60%, preferably to about 30% by weight of the composition.

Nonlimiting examples of surfactants useful herein include:

a) $C_{11}$–$C_{18}$ alkyl benzene sulfonates (LAS);

b) $C_{10-C20}$ primary, branched-chain and random alkyl sulfates (AS);

c) $C_{10}$–$C_{18}$ secondary (2,3) alkyl sulfates having the formula:

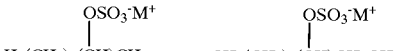

wherein x and (y+1) are integers of at least about 7, preferably at least about 9; said surfactants disclosed in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

d) $C_{10}$–$C_{18}$ alkyl alkoxy sulfates ($AE_xS$) wherein preferably x is from 1–7;

e) $C_{10}$–$C_{18}$ alkyl alkoxy carboxylates preferably comprising 1–5 ethoxy units;

f) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated he rein by reference;

g) Alkylpolysaccharides as disclosed in U.S. Pat. No. 4,565,647 Llenado, issued Jan. 26, 1986, incorporated herein by reference;

h) Polyhydroxy fatty acid amides having the formula:

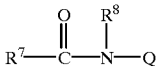

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof; preferred Q is derived from a reducing sugar in a reductive amination reaction, more preferably Q is a glycityl moiety; Q is more preferably selected from the group consisting of $—CH_2(CHOH)_n CH_2OH$, $—CH(CH_2OH)(CHOH)_{n-1}CH_2OH$, $—CH_2(CHOH)_2—(CHOR')(CHOH)CH_2OH$, and alkoxylated derivatives thereof, wherein n is an integer from 3 to 5, inclusive, and R' is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

Additionally and preferably, the surfactant may be a midchain branched alkyl sulfate, midchain branched alkyl alkoxylate, or midchain branched alkyl alkoxylate sulfate. These surfactants are further described in Ser. No. 60/061,971, Oct. 14, 1997, Ser. No. 60/061,975, Oct. 14, 1997, Ser. No. 60/062,086, Oct. 14, 1997, Ser. No. 60/061,916, Oct. 14, 1997, Ser. No. 60/061,970, Oct. 14, 1997, Ser. No. 60/062,407, Oct. 14, 1997,. Other suitable mid-chain branched surfactants can be found in U.S. patent applications Ser. Nos. 60/032,035, 60/031,845, 60/031,916, 60/031,917, 60/031,761, 60/031,762 and 60/031,844. Mixtures of these branched surfactants with conventional linear surfactants are also suitable for use in the present compositions.

Other preferred anionic surfactants are the modified alkyl benzene sulfonate surfactants, or MLAS. Some suitable MLAS surfactants, methods of making them and exemplary compositions are further described in copending U.S. patent applications Ser. Nos. 60/053,319, 60/053,318, 60/053,321, 60/053,209, 60/053,328, 60/053,186, 60/055,437, 60/105,017, and 60/104,962.

Detergency Builders

The detergent composition may also include a conventional detergent builder in conjunction with the zeolites of the present invention, to assist in controlling mineral hardness and to enhance the removal of particulate soils. Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locations. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crisping agent in granular formulations, as a stabilizing agent for oxygen bleaches, and as a component of suds control systems. Amorphous silicates can be used but care must be taken to keep them at low levels if they are spray-dried with the microclusters of the present invention. In general a detergent composition containing microclusters of the present invention should contain less than about 3% by weight silicate, preferably less than about 1.5% and most preferably less than about 0.5%.

Examples of carbonate builders are the alkaline earth and alkali metal carbonates as disclosed in German Patent Application No. 2,321,001 published on Nov. 15, 1973.

As part of the overall zeolite system of detergent compositions according to the present invention, conventional aluminosilicate builders other than those added in the form of microclusters as described herein are also useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 1–7 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred. Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Adjunct Ingredients

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Enzymes—Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzyme Stabilizers—The enzymes employed herein are stabilized by the presence of water-soluble sources of calcium and/or magnesium ions in the finished compositions which provide such ions to the enzymes. (Calcium ions are generally somewhat more effective than magnesium ions and are preferred herein if only one type of cation is being used.) Additional stability can be provided by the presence of various other art-disclosed stabilizers, especially borate species: see Severson, U.S. Pat. No. 4,537,706.

Bleaching Compounds—Bleaching Agents and Bleach Activators—The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator. Mixtures of bleaching agents can also be used.

Polymeric Soil Release Agent—Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Chelating Agents—The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylates amines; liquid detergent compositions typically contain about 0.01% to about 5%.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Brightener—Any optical brighteners or other brightening or whitening agents known in the art can be incorporated at levels typically from about 0.05% to about 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Dye Transfer Inhibiting Agents—The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of Nvinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

Fabric Integrity Polymers—Linear amine based polymer, oligomer or copolymer materials which are suitable for use in laundry operations and provide the desired fabric appearance and integrity benefits can be characterized by the following general formula:

A

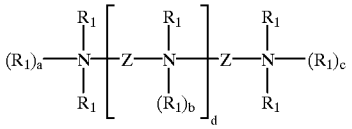

wherein:

each $R_1$ is independently selected from the group consisting of H, linear or branched $C_1$–$C_{12}$ alkyl, hydroxyalkyl, cycloalkyl, aryl, alkylaryl, piperidinoalkyl and other substituted derivatives of piperidine, morpholinoalkyl and other substituted derivatives of morpholine, substituted derivatives of aryl, substituted derivatives of alkylaryl,

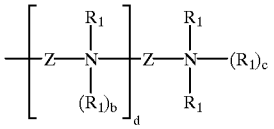

and mixtures thereof;

A is a compatible anion;

a=0 or 1;

b=0 or 1;

c=0 or 1;

d=from 0 to about 50, preferably from 0 to about 25 and most preferably from about 4 to about 20;

e=number required to obtain charge neutrality;

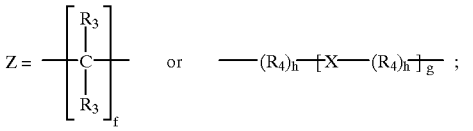

wherein:

each $R_3$ is independently selected from the group consisting of H, $C_1$–$C_{12}$ alkyl, aryl, alkylaryl, substituted derivatives of aryl, substituted derivatives of alkylaryl, hydroxy, amino, alkoxy, halogen and mixtures thereof;

each $R_4$ is independently selected from the group consisting of linear or branched alkylene, hydroxyalkylene, and substituted alkylene residues;

X is selected from the group consisting of phenylene, cyclohexylene, substituted residues of phenylene, substituted residues of cyclohexylene, —O—, —COO— and —CON($R_5$)—;

$R_5$ is selected from the group consisting of H, $C_1$–$C_4$ alkyl and hydroxyalkyl;

f=from about 2 to about 12;

g=from about 1 to about 10 when X is —COO— or —CON($R_5$)—;

g=from about 1 to about 100 when X is —O—; otherwise g=1;

h=0 or 1;

provided that when one $R_3$ group is hydroxy or amino, the other $R_3$ group on the same carbon is not a hydroxy, amino or halogen; and further provided that within Z no carbon has more than one substituent selected from the group consisting of hydroxy, amino, and halo.

The linear amine based polymer, oligomer or copolymer materials defined above can be used as a washing solution additive in either granular or liquid form. Alternatively, they can be admixed to granular detergents, dissolved in liquid detergent compositions or added to a fabric softening composition. The linear amine based fabric treatment component of the detergent compositions herein will generally comprise from about 0.1% to about 5% by the weight of the detergent composition. More preferably, such linear amine based fabric treatment materials will comprise from about 0.5% to about 4% by weight of the detergent compositions, most preferably from about 0.75% to about 3%.

Other Ingredients—A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If desired, soluble magnesium salts such as $MgCl_2$, $MgSO_4$, and the like, can be added at levels of, typically, 0.1%–2%, to provide additional suds and to enhance grease removal performance.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

The detergent compositions herein will preferably be formulated such that, during use in aqueous cleaning operations, the wash water will have a pH of from about 6.5 to about 11, preferably from about 8.5 to about 10.7. Techniques for controlling pH at recommended usage levels include the use of buffers, alkalis, acids, etc., and are well known to those skilled in the art.

High Density Detergent Composition Processes

Spray-drying towers can be used to make granular laundry detergents or base powders. These often have a density less than about 500 g/l. Typically, an aqueous slurry of ingredients is passed through a spray-drying tower at temperatures of about 175° C. to about 225° C.

Additional process steps must be used to obtain high density, low dosage detergents. "High density" means greater than about 550, typically greater than about 650, grams/liter or "g/l"). Thus spray-dried granules can be densified by loading a liquid, often a nonionic surfactant, into the pores of the granules and/or passing them through one or more high speed mixer/densifiers such as a device sold as a "Lödige CB 30" or "Lödige CB 30 Recycler". This comprises a static cylindrical mixing drum having a central rotating shaft on which are mounted mixing/cutting blades. Ingredients for the detergent composition are introduced into the drum and the shaft/blade assembly is rotated at speeds in the range of 100–2500 rpm to provide thorough mixing/densification. See U.S. Pat. Nos. 5,149,455 and 5,565,422. Other suitable commercial apparatus includes the "Shugi Granulator" and the "Drais K-TTP 80.

Spray-dried granules can also be densified by treating them in a moderate speed mixer/densifier so as to obtain particles, for which the "Lödige KM" (Series 300 or 600) or "Lödige Ploughshare" mixer/densifiers are suitable and are typically operated at 40–160 rpm. Other useful equipment includes the "Drais K-T 160". This process step using a moderate speed mixer/densifier (e.g. Lödige KM) can be used alone or sequentially with the aforementioned high speed mixer/densifier (e.g. Lödige CB) to achieve the desired density. Other types of granules manufacturing apparatus useful herein include the apparatus disclosed in U.S. Pat. No. 2,306,898, to G. L. Heller, Dec. 29, 1942.

While it may be more suitable to use the high speed mixer/densifier followed by the low speed mixer/densifier, the reverse sequential mixer/densifier configuration can also be used. One or a combination of various parameters including residence times in the mixer/densifiers, operating temperatures of the equipment, temperature and/or composition of the granules, the use of adjunct ingredients such as liquid binders and flow aids, can be used to optimize densification of the spray-dried granules. By way of example, see the processes in U.S. Pat. No. 5,133,924; U.S. Pat. No. 4,637,891, (granulating spray-dried granules with a liquid binder and aluminosilicate); U.S. Pat. No. 4,726,908, (granulating spray-dried granules with a liquid binder and aluminosilicate); and U.S. Pat. No. 5,160,657, (coating densified granules with aluminosilicate).

Heat sensitive or highly volatile detergent ingredients are preferably incorporated into the detergent composition without resorting to spray drying, for example, by feeding thermally sensitive or volatile ingredients continuously or batchwise into mixing/densifying equipment. One preferred embodiment involves charging a surfactant paste and an anhydrous material into a high speed mixer/densifier (e.g. L ödige CB) followed by a moderate speed mixer/densifier (e.g. Lödige KM) to form high density agglomerates. See U.S. Pat. No. 5,366,652 and U.S. Pat. No. 5,486,303. The liquid/solids ratio of ingredients can be selected to obtain high density agglomerates that are more free flowing and crisp. See U.S. Pat. No. 5,565,137.

Optionally, the process may include one or more streams of undersized particles. These can be recycled to the mixer/densifiers for further agglomeration or build-up. Oversized particles can be sent to grinding apparatus, the product of which is fed back to the mixing/densifying equipment. Such recycles facilitate overall particle size control giving in finished compositions which having a relatively uniform distribution of particle size (400–700 microns) and density (>550 g/l). See U.S. Pat. No. 5,516,448 and U.S. Pat. No. 5,489,392. Other suitable processes which do not call for spray-drying are described in U.S. Pat. No. 4,828,721, U.S. Pat. No. 5,108,646 and U.S. Pat. No. 5,178,798.

In yet another embodiment, the high density detergent compositions can be produced using a fluidized bed mixer in which the ingredients are combined as an aqueous slurry (typically 80% solids content) and sprayed into a fluidized bed to provide finished granules. Optionally prior to fluid bed mixing the slurry can be treated using the aforementioned Lödige CB mixer/densifier or a "Flexomix 160" mixer/densifier, available from Shugi. Fluidized bed or moving beds of the type available under the tradename "Escher Wyss" can also be used.

Another alternate process involves feeding a liquid acid precursor of an anionic surfactant, an alkaline inorganic material (e.g. sodium carbonate) and optionally other detergent ingredients into a high speed mixer/densifier (residence time 5–30 seconds) so as to form particles containing a partially or totally neutralized anionic surfactant salt and the other starting detergent ingredients. Optionally, the contents in the high speed mixer/densifier can be sent to a moderate speed mixer/densifier (e.g. Lödige KM) for further mixing resulting in the finished high density detergent composition. See U.S. Pat. No. 5,164,108.

Optionally, high density detergent compositions can be produced by blending conventional spray-dried detergent granules with detergent agglomerates in various proportions (e.g. a 60:40 weight ratio of granules to agglomerates) produced by one or a combination of the processes discussed herein. Additional adjunct ingredients such as enzymes, perfumes, brighteners and the like can be sprayed or admixed with the agglomerates, granules or mixtures thereof produced by the processes discussed herein. For example, see U.S. Pat. No. 5,569,645.

Detergent Compositions

In order to make the present invention more readily understood, reference is made to the following examples, which are intended to be illustrative only and not intended to be limiting in scope.

Abbreviations used in Examples

| | |
|---|---|
| LAS | Sodium $C_{11-13}$ alkyl benzene sulfonate (linear, branched or mixed) |
| Alkyl Sulfate | CxyAS: Alkyl sulfate, typically sodium salt form, derived from fatty alcohol containing from x to y carbon atoms. Examples include sodium tallow alkyl sulfate (TAS) and primary, guerbet, and mid-chain branched alkyl sulfates containing from 10 to 20 carbon atoms (more typically from 14 to 16 or from 16 to 18) or mixtures thereof. |
| $MBAS_x$ | Mid-chain branched primary alkyl (average total carbons = x) sulfate |
| Alkyl Alkoxy Sulfate | Sodium salt of linear or branched fatty alcohol condensed with one or more moles of ethylene oxide, propylene oxide, esp. sodium $C_{1x}$–$C_{1y}$ alkyl sulfate condensed with z moles of ethylene oxide, e.g., C15E1S. |
| $MBAE_xS_z$ | Mid-chain branched primary alkyl (average total carbons = z) ethoxylate (average EO = x) sulfate, sodium salt |
| $MBAE_x$ | Mid-chain branched primary alkyl (average total carbons = x) ethoxylate (average EO = 8) |
| HLAS | alkylbenzene sulfonic acid |
| MLAS | Crystallinity disrupted Sodium alkyl benzene sulfonate |
| HSAS | Mid-chain branched alkyl sulfate |
| Nonionic | linear or branched nonionic surfactant, typically CxyEz, derived from fatty alcohol with chainlength of from x to y condensed with an average of z moles of ethylene oxide Suitable examples include C25E3, C24E5, C45E7. |
| Glucamide | $C_{12}$–$C_{14}$ (coco) alkyl N-methyl glucamide<br>or<br>$C_{16}$–$C_{18}$ alkyl N-methyl glucamide |

-continued

| | |
|---|---|
| Amine Oxide | linear or branched $C_{12}$–$C_{18}$ Alkyldimethylamine N-Oxide |
| QAS | Quaternary ammonium surfactant, e.g., dodecyltrimethylammonium chloride or $R_2.N^+(CH_3)_2(C_2H_4OH)\ X^-$ with $R_2 = C_{12}$–$C_{14}$ and $X^- = Cl^-$ |
| Fatty Acid | Sodium linear alkyl carboxylate derived from an 80/20 mixture of tallow and coconut fatty acids (longer-chain soaps may be dual-functional and contribute to suds suppression); $C_{12}$–$C_{14}$ topped whole cut fatty acids; mixtures |
| microclusters | microclusters of zeolite A in accordance with the present invention |
| Conventional/optional zeolites | |
| Zeolite A | Hydrated sodium aluminosilicate of formula $Na_{12}(A10_2SiO_2)_{12}.27\ H_2O$ having an average particle size from 2 to 5 micrometers. |
| Zeolite X | Zeolite X |
| Zeolite AX | Zeolites A, X co-crystallized |
| Zeolite P | Zeolite P |
| Zeolite MAP | maximum aluminum type Zeolite P |
| Silicate system | 2r or 3r sodium silicate; crystalline layered silicate of formula δ-$Na_2Si_2O_5$; Amorphous sodium silicate ($SiO_2$:$Na_2O$ = 2.0:1); mixtures thereof |
| Phosphates: -one or more of | |
| STPP | Anhydrous sodium tripolyphosphate |
| TSPP | Tetrasodium pyrophosphate |
| non-polymer type polycarboxylate: one or more of: - | |
| Citrate | Anhydrous citric acid; tri-sodium citrate dihydrate of activity 86.4% with a particle size distribution between 425 μm and 850 μm; mixtures thereof |
| TMS/TDS | Tartrate Monosuccinate/Tartrate Disuccinate, Sodium Salts |
| ODS | 2,2'-oxydisuccinate, Sodium Salts |
| CMOS | Carboxymethyloxysuccinate, Sodium Salts |
| NTA | Nitrilotriacetic Acid, Sodium Salts |
| Carbonate | Anhydrous sodium or potassium carbonate, e.g., with particle size between 200 μm and 900 μm for admix; or lower, e.g., below 100 μm, if to be further agglomerated. |
| Polymer-type polycarboxylate | any polycarboxylate of m.w. above about 1,000, especially sodium salt of copolymer of 1:4 maleic/acrylic acid, average molecular weight about 70,000, sodium salt; Sodium polyacrylate of average molecular weight 4,500; mixtures thereof; or mixtures of said polymers with any PEG. A preferred polymer-type polycarboxylate bas polyglyoxylate structural units |
| Carbohydrate antiredeposition agent | Sodium carboxymethyl cellulose; methyl cellulose ether with a degree of polymerization of 650; starch-derived, sugar-derived, sorbitol-derived or any other carbohydrate-derived antiredeposition agent or ash buildup prevention agent, or mixtures thereof. |
| Enzyme system: one or more of: - | |
| Protease | Proteolytic enzyme of activity 4 KNPU/g |
| Alcalase | Proteolytic enzyme of activity 3 AU/g |
| Cellulase | Cellulolytic enzyme of activity 1000 CEVU/g |
| Amylase | Amylolytic enzyme of activity 120 KNU/g |
| Lipase | Lipolytic enzyme of activity 100 KLU/g |
| Endolase | Endoglucanase enzyme of activity 3000 CEVU/g |
| PB4 | Sodium perborate tetrahydrate of nominal formula $NaBO_2.3\ H_2O.H_2O_2$. any of these in coated or uncoated forms; or mixtures thereof |
| PB1 | Anhydrous sodium perborate bleach of nominal formula $NaBO_2.H_2O_2$ |
| PC | Sodium percarbonate of nominal formula $2\ Na_2CO_3.3\ H_2O_2$ |
| Hydrophitic Bleach Activator | any water-soluble acylated di- or lower poly-amine, esp. Tetraacetylethylenediamine |
| NOBS | nonanoyloxybenzene sulfonate in the form of the sodium salt; NAC-OBS, i.e., (6-nonamidocaproyl) oxybenzene sulfonate; mixtures; or similar |
| Organic Bleach Booster | e.g., omega-(3,4-dihydroisoquinolinium alkane sulfonate(s) of |
| Photobleach | Sulfonated zinc phthlocyanine encapsulated in bleach dextrin soluble polymer; or low-hue photobleach. |
| Chelant System: one or more of: | |
| DTPA | Diethylene triamine pentaacetic acid |
| DTPMP | Diethylene triamine penta (methylene phosphonate) |

-continued

| | |
|---|---|
| EDDS | Ethylenediamine-N,N'-disuccinic acid, (S,S) isomer in the form of its sodium salt. |
| HEDP | 1,1-hydroxyethane diphosphonic acid |
| Brightener | Disodium 4,4'-bis(2-sulphostyryl)biphenyl; Disodium 4,4'-bis(4-anilino-6-morpholino-1.3.5-triazin-2-yl)amino) stilbene-2:2'-disulfonate; mixtures |
| Soil Release Agent: one or more of: | |
| SRP 1 | Sulfobenzoyl and capped esters with oxyethylene oxy and terephthaloyl backbone |
| SRP 2 | Diethoxylated poly (1,2 propylene terephthalate) short block polymer |
| TEPAE | Tetraethylenepentaamine ethoxylate |
| PVP | Polyvinylpyrrolidine polymer, with an average molecular weight of 60,000 |
| PVNO | Polyvinylpyridone N-oxide polymer, with an average molecular weight of 50,000 |
| PVPVI | Copolymer of polyvinylpyrolidone and vinylimidazole, with an average molecular weight of 20,000 |
| Antifoam System: | e.g., polydimethylsiloxane foam controller with siloxane-oxyalkylene copolymer as dispersing agent with a ratio of said foam controller to said dispersing agent of 10:1 to 100:1; may be complemented by fatty acid(s). |
| Other materials | |
| Bicarbonate | Anhydrous sodium bicarbonate with a particle size distribution between 400 $\mu$m and 1200 $\mu$m |
| Sulfate | Anhydrous sodium sulfate |
| Stabilizers, process aids, other minors e.g., one or more of: | |
| Borate | Sodium borate |
| Wax | Paraffin wax |
| PEGx | Polyethylene glycol, with a molecular weight of x |
| PEO | Polyethylene oxide, with an average molecular weight of 50,000 |

EXAMPLES 1–6

Granular laundry detergents for use in domestic appliances or handwashing of laundry at from 100 to 10,000 ppm, depending on appliance and/or water and/or conditions, are prepared in accordance with the invention:

| Ingredient % | 1 | 2 | 3 | 4 | 5 | 6 |
|---|---|---|---|---|---|---|
| LAS (0–35) | 4 | — | 10 | 20 | 30 | 35 |
| Alkyl Sulfate (0–20) | 10 | 3 | 1 | — | — | - |
| Alkyl Alkoxy Sulfate (0–5) | — | — | 0.5 | — | 5 | — |
| Nonionic (0–15) | 5 | 10 | 2 | 0.5 | 1 | — |
| Glucamide (0–5) | 3 | 1 | — | — | — | — |
| Amine Oxide (0–2) | 0.5 | — | — | 2 | — | — |
| QAS (0–2) | — | — | — | — | 1.8 | 2 |
| microclusters | 5 | 5 | 25 | 10 | 30 | 5 |
| Conventional Zeolites | — | 20 | — | — | — | — |
| Carbonate (0–30) | 10 | 10 | 5 | 15 | — | 20 |
| Phosphates (0–30) | — | — | — | — | — | 20 |
| Silicate system (0–20) | 5 | 1 | 3 | — | 2 | 10 |
| Non-polymer type polycarboxylate (0–20) | — | — | 5 | — | 5 | — |
| Polymer-type polycarboxylate (0–20) | 1 | 5 | — | 10 | 4 | — |
| Carbohydrate antiredeposition agent (0–10) | 0.1 | 0.2 | 5 | 0.3 | 0.2 | — |
| Primary Oxygen Bleach (0–20) | 20 | 15 | 10 | 5 | 3 | — |
| Hydrophilic Bleach Activator (0–10) | — | 2 | — | — | 4 | 2 |
| Hydrophobic Bleach Activator (0–10) | — | 2 | 1 | — | 5 | — |
| Organic Bleach Booster (0–5) | — | — | — | 2 | — | — |
| Transition-metal bleach catalyst (0–10,000 ppm) | 10 | 100 | 1000 | — | 50 | 10000 |
| Photobleach (0–1000 ppm) | — | — | 10 | — | 5 | — |
| Chelant System (0–3) | 2 | 1 | 0.5 | 3 | 1 | 0 |
| Enzyme System (0–8) | 8 | — | 3 | 4 | 6 | 1 |

-continued

| Ingredient % | 1 | 2 | 3 | 4 | 5 | 6 |
|---|---|---|---|---|---|---|
| Brightener (0–2) | 0.1 | 0.1 | 0.1 | 0.2 | 0.3 | 1 |
| Soil Release Agent (0–5) | — | 0.1 | 1 | 2 | — | 0.3 |
| Perfume (0–5) | 0.01 | 0.1 | — | 3 | 2 | 1 |
| Antifoam system (0–5) | 0.05 | 0.1 | 0.2 | 0.5 | 0.7 | — |
| Sulfate, stabilizers, process aids, minors to | 100% | 100% | 100% | 100% | 100% | 100% |
| Density in g/liter (range) | 200–900 | 200–900 | 200–900 | 200–900 | 200–900 | 200–900 |

EXAMPLES 7–12

Laundry Bar compositions are prepared according to the present invention.

| Ingredient | 7 | 8 | 9 | 10 | 11 | 12 |
|---|---|---|---|---|---|---|
| Tallow Soap | 38.00 | 28.80 | 0.00 | 0.00 | 0.00 | 0.00 |
| Coconut Soap | 9.50 | 7.20 | 0.00 | 0.00 | 0.00 | 0.00 |
| Alkyl Glycerate Ether Sulphonate | 0.00 | 4.00 | 0.00 | 0.00 | 0.00 | 0.00 |
| Coco(C12–C14)Alkyl Sulfate | 0.00 | 0.00 | 15.05 | 15.05 | 0.00 | 0.00 |
| C12–C14 Amine Oxide | 0.00 | 0.00 | 0.00 | 2.50–4.00 | 0.00 | 2.50–4.50 |
| LAS | 2.50 | 2.50 | 6.45 | 15.00–16.50 | 22.00 | 19.0%–22% |
| Coco Fatty Alcohol | 0.00 | 0.00 | 1.5 | 0.00 | 0.00 | 0.00 |
| Coconut Monethanolamide | 0.00 | 0.00 | 1.00 | 0.00 | 0.00 | 0.00–0.00 |
| Sodium Carbonate | 0.00–6.00 | 0.00–6.00 | 0.00–15.00 | 0.00–12.00 | 0.00–12.00 | 0.00–15.00 |
| STPP | 5.00 | 5.00 | 0.00 | 0.00 | 0.00 | 0.00 |
| Conventional Zeolite | 0.00 | 0.00 | 1.00 | 1.00 | 1.00 | 1.00 |
| Carboxymethyl Cellulose | 0.5–1.5 | 0.5–1.5 | 0.40 | 0.50 | 0.00 | 0.50 |
| Polymers | 0.00 | 0.00 | 0.64 | 0.40 | 1.20 | 1.20 |
| DTPA | 0.60 | 0.60 | 0.90 | 0.00 | 0.80 | 0.80 |
| Microclusters | 5.00 | 5.00 | 18.00 | 18.00 | 20.00 | 20.00 |
| Calcium Carbonate | 0.00 | 0.00 | 0.00–21.5 | 0.00–25.00 | 0.00 | 0.00 |
| Talc | 0.00–25.00 | 25.00 | 0.00 | 0.00 | 0.00–10.00 | 0.00–10.00 |
| Sodium Perborate | 0.0–4.5 | 0.0 | 4.50 | 0.00–4.50 | 4.50 | 4.50 |
| Amylase | 0.00 | 0.00 | 0.05 | 0.00 | 0.00 | 0.00 |
| Cellulase | 0.00 | 0.00 | 0.00 | 0.08 | 0.00 | 0.02 |
| Protease | 0.00–0.12 | 0.00 | 0.10 | 0.00–0.12 | 0.12 | 0.10 |
| Brightener | 0.20 | 0.20 | 0.20 | 0.20 | 0.22 | 0.32 |
| Photobleach | 0.005 | 0.005 | 0.005 | 0.005 | 0.005 | 0.005 |
| PEG | 0.00 | 0.00 | 0.00 | 0.00 | 1.00 | 1.00 |
| Sodium Borate | 0.00 | 0.00 | 0.00 | 0.00 | 1.50 | 1.00 |
| CaO | 0.00 | 0.00 | 0.00 | 1.80 | 1.80 | 1.80 |
| Sodium Silicate | 0.00 | 0.00 | 0.00 | 3.3 | 2.70 | 2.70 |
| Sodium Sulfate | 0.0 | 0.00 | 9.00 | 0.00 | 0.00 | 0.00 |
| MgSO4 | 2.00 | 1.85 | 0.00 | 0.00 | 3.00 | 0.00 |
| Water | 17.00 | 17.00 | 3.00 | 2.00–3.00 | 4.70 | 5.0 |
| Balance to 100.00% | balance | balance | balance | balance | balance | balance |

Liquid detergent compositions prepared in accordance with the present invention.

EXAMPLES 13–17

| Ingredient | 13 | 14 | 15 | 16 | 17 |
|---|---|---|---|---|---|
| MLAS | 1–7 | 7–12 | 12–17 | 17–22 | 1–35 |
| Any combination of: | 15–21 | 10–15 | 5–10 | 0–5 | 0–25 |

-continued

| Ingredient | 13 | 14 | 15 | 16 | 17 |
|---|---|---|---|---|---|
| C25 AExS*Na (x = 1.8 – 2.5) | | | | | |
| MBAE1.8S15.5 | | | | | |
| MBAS15.5 | | | | | |
| C25 AS (linear to high 2-alkyl) | | | | | |
| C14–17 NaPS | | | | | |
| C12–16 SAS | | | | | |
| C18 1,4 disulfate | | | | | |
| LAS | | | | | |
| C12–16 MBS | | | | | |
| LMFAA | 0–3.5 | 0–3.5 | 0–3.5 | 0–3.5 | 0–8 |
| C23E9 or C23E6.5 | 0–2 | 0–2 | 0–2 | 0–2 | 0–8 |
| APA | 0–0.5 | 0–0.5 | 0–0.5 | 0–0.5 | 0–2 |
| Citric Acid | 5 | 5 | 5 | 5 | 0–8 |
| Fatty Acid (TPK or C12/14) | 2–7.5 | 2–7.5 | 2–7.5 | 2–7.5 | 0–14 |
| Fatty Acid (RPS) | 0–3.1 | 0–3.1 | 0–3.1 | 0–3.1 | 0–3.1 |
| EtOH | 4 | 4 | 4 | 4 | 0–8 |
| PG | 6 | 6 | 6 | 6 | 0–10 |
| MEA | 1 | 1 | 1 | 1 | 0–3 |
| NaOH | 3 | 3 | 3 | 3 | 0–7 |
| Na TS | 2.3 | 2.3 | 2.3 | 2.3 | 0–4 |
| Na formate | 0.1 | 0.1 | 0.1 | 0.1 | 0–1 |
| Borax | 2.5 | 2.5 | 2.5 | 2.5 | 0–5 |
| Protease | 0.9 | 0.9 | 0.9 | 0.9 | 0–1.3 |
| Lipase | 0.06 | 0.06 | 0.06 | 0.06 | 0–0.3 |
| Amylase | 0.15 | 0.15 | 0.15 | 0.15 | 0–0.4 |
| Cellulase | 0.05 | 0.05 | 0.05 | 0.05 | 0–0.2 |
| PAE | 0–0.6 | 0–0.6 | 0–0.6 | 0–0.6 | 0–2.5 |
| PIE | 1.2 | 1.2 | 1.2 | 1.2 | 0–2.5 |
| PAEC | 0–0.4 | 0–0.4 | 0–0.4 | 0–0.4 | 0–2 |
| SRP 2 | 0.2 | 0.2 | 0.2 | 0.2 | 0–0.5 |
| Microclusters | 5 | 5 | 10 | 20 | 20 |
| Brightener 1 or 2 | 0.15 | 0.15 | 0.15 | 0.15 | 0–0.5 |
| Silicone antifoam | 0.12 | 0.12 | 0.12 | 0.12 | 0–0.3 |
| Fumed Silica | 0.0015 | 0.0015 | 0.0015 | 0.0015 | 0–0.003 |
| Perfume | 0.3 | 0.3 | 0.3 | 0.3 | 0–0.6 |
| Dye | 0.0013 | 0.0013 | 0.0013 | 0.0013 | 0–0.003 |
| Moisture/minors | Balance | Balance | Balance | Balance | Balance |
| Product pH (10% in DI water) | 7.5–8.5 | 7.5–8.5 | 7.5–8.5 | 7.5–8.5 | 6–9.5 |

Tablet compositions prepared in accordance with the present invention.

EXAMPLES 18–20

| Ingredient | 18 | 19 | 20 |
|---|---|---|---|
| Anionic agglomerates | 34 | 34 | 34 |
| Nonionic agglomerates | 9.57 | 9.57 | 9.57 |
| Layered silicate | 2.7 | 1.5 | 1.5 |
| Sodium percarbonate | 12.43 | 12.43 | 12.43 |
| Bleach activator agglomerates | 6.48 | 6.48 | 6.48 |
| Sodium carbonate | 19.01 | 18.96 | 18.46 |
| EDDS/Sulphate particle | 0.50 | 0.50 | 0.50 |
| Tetrasodium salt of Hydroxyethane Diphosphonic acid | 0.8 | 0.8 | 0.8 |
| Fluorescer | 0.11 | 0.11 | 0.11 |
| Zinc Phthalocyanine sulphonate encapsulate[6] | 0.027 | 0.027 | 0.027 |
| Soap powder | 1.49 | 0.74 | 0.74 |
| Sud suppressor[7] | 1.8 | 1.8 | 1.8 |
| Citric acid | 7.51 | 7.51 | 7.51 |
| Protease | 0.8 | 0.8 | 0.8 |
| Cellulase | 0.16 | 0.16 | 0.16 |
| Amylase | 0.61 | 0.61 | 0.61 |
| Microclusters | 5 | 10 | 20 |
| Polyethylene glycol MW of 4000 flakes | — | 0.5 | 1.5 |
| Sodium salt of Linear Alkyl Benzene Sulphonate/ DiIsoPropylBenzeneSulphonate[8] | 1 | 1 | 1.5 |

What is claimed is:

1. A detergent composition comprising:

a) a detersive surfactant system;

b) a zeolite system comprising, (i) from about 25% to about 100% by weight of microclusters of submicron crystallites of an aluminosilicate ion exchange material selected from the group consisting of zeolite A, zeolite X, zeolite Y, chabazite and mixtures thereof; and (ii) from about 0 to about 75% by weight of conventional aluminosilicates other than those comprising said microclusters; and c) detergent adjunct materials.

2. A detergent composition according to claim 1 wherein the submicron crystallites have a particle size of from about 0.05 $\mu$M to about 1.0 $\mu$M and the microclusters have a particle size of from about 1.0 $\mu$M to about 7.0 $\mu$M.

3. A detergent composition according to claim 1 wherein the zeolite system is comprised of:

(i) from about 50% to about 100% by weight of microclusters of submicron crystallites of an aluminosilicate ion exchange material selected from the group consisting of zeolite A, zeolite X, zeolite Y, chabazite and mixtures thereof; and (ii) from about 0 to about 50% by weight of conventional aluminosilicates other than those comprising said microclusters.

4. A detergent composition according to claim 1 wherein the aluminosilicate ion exchange material is zeolite type A.

5. A detergent composition according to claim 1 wherein said conventional aluminosilicate is selected from the group consisting of sodalite, hydroxysodalite, zeolite type P, up to maximum aluminum type P and mixtures thereof.

6. A detergent composition comprising:

a) from about 0.1% to about 95% by weight of a detersive surfactant system; and b) from about 5% to about 75% of a zeolite system comprising (i) from about 25% to about 100% by weight of microclusters of submicron crystallites of an aluminosilicate ion exchange material selected from the group consisting of zeolite A, zeolite X, zeolite Y, chabazite and mixtures thereof; and (ii) from about 0 to about 75% by weight of conventional aluminosilicates other than those comprising said microclusters; and c) balance detergent adjunct materials.

7. A detergent composition according to claim 6 wherein the zeolite system is comprised of (i) from about 50% to about 100% by weight of microclusters of submicron crystallites of an aluminosilicate ion exchange material selected from the group consisting of zeolite A, zeolite X, zeolite Y, chabazite and mixtures thereof; and (ii) from about 0 to about 50% by weight of conventional aluminosilicates other than those comprising said microclusters.

8. A detergent composition according to claim 1 wherein the submicron crystallites have a particle size of from about 0.1 $\mu$M to about 0.8 $\mu$M and the microclusters have a particle size of from about 2.0 $\mu$M to about 5.0 $\mu$M.

9. A granular detergent composition comprising:

a) a detersive surfactant system;

b) a zeolite system comprising (i) from about 25% to about 100% by weight of microclusters of submicron crystallites of an aluminosilicate ion exchange material selected from the group consisting of zeolite A, zeolite X, zeolite Y, chabazite and mixtures thereof; and (ii) from about 0 to about 75% by weight of conventional aluminosilicates other than those comprising said microclusters; and c) detergent adjunct materials;

the detergent composition having a mean particle size of from about 0.15 mm to about 1.7 mm.

10. A granular detergent composition according to claim 9 wherein the zeolite system is comprised of:

a) from about 50% to about 100% by weight of microclusters of submicron crystallites of an aluminosilicate ion exchange material selected from the group consisting of zeolite A, zeolite X, zeolite Y, chabazite and mixtures thereof; and b) from about 0 to about 50% by weight of conventional aluminosilicates other than those comprising said microclusters.

11. A granular detergent composition according to claim 9 wherein the aluminosilicate ion exchange material is zeolite type A.

12. A granular detergent composition according to claim 9 wherein the submicron crystallites have a particle size of from about 0.05 $\mu$M to about 1.0 $\mu$M and the microclusters have a total particle size of from about 1.0 M to about 7.0 $\mu$M.

13. A granular detergent composition according to claim 9 wherein the submicron crystallites have a particle size of from about 0.1 $\mu$M to about 0.8 $\mu$M and the microclusters have a particle size of from about 2.0 $\mu$M to about 5.0 $\mu$M.

14. A granular detergent composition according to claim 9 wherein said composition has a bulk density of from about 200 g/L to about 900 g/L.

15. A granular detergent composition according to claim 9 wherein said composition has a bulk density of from about 300 g/L to about 500 g/L.

16. A detergent composition comprising:

a) a detersive surfactant system;

b) a zeolite system comprising (i) from about 25% to about 100% by weight of microclusters of submicron crystallites of an aluminosilicate ion exchange material selected from the group consisting of zeolite A, zeolite X, zeolite Y, chabazite and mixtures thereof; and (ii) from about 0 to about 75% by weight of conventional aluminosilicates other than those comprising said microclusters; and c) detergent adjunct materials;

the detergent composition having a mean particle size of from about 0.15 mm to about 1.7 mm;

wherein the detergent is in the form of a tablet.

17. A detergent composition according to claim 16 wherein the zeolite system is comprised of:

a) from about 50% to about 100% by weight of microclusters of submicron crystallites of an aluminosilicate ion exchange material selected from the group consisting of zeolite A, zeolite X, zeolite Y, chabazite and mixtures thereof; and b) from about 0 to about 50% by weight of conventional aluminosilicates other than those comprising said microclusters.

18. A detergent composition according to claim 1 wherein the microclusters are added to the final detergent composition as a particle in conjunction with an anionic surfactant wherein said particle is agglomerates, extrudates, or spray dried granules of said zeolite and surfactant systems.

19. A detergent composition according to claim 12 wherein the surfactant system contains an anionic surfactant selected from the group consisting of linear and mid-chain branched alkyl sulfates, alkyl alkoxy sulfates, alkylbenzene sulfonates and mixtures thereof.

20. A method of sequestering hardness ions from wash water in from about 0.1 to about 5.0 minutes comprising the steps of:

A) preparing a detergent composition comprising (i) conventional detergent ingredients selected from the group consisting of surfactants, builders, chelants, brighteners, bleaching agents, enzymes, soil release polymers, dye transfer inhibitors, fillers, perfumes and mixtures thereof, and (ii) a zeolite system comprising:

a) from 50% to 100% by weight of microclusters of submicron crystallites of an aluminosilicate ion exchange material selected from the group consisting of zeolite A, zeolite X, zeolite Y, chabazite and mixtures thereof; and b) from 0 to about 50% by weight of conventional aluminosilicates other than those comprising said microclusters; and B) contacting fabrics with said detergent composition.

21. A detergent particle having a mean particle size of from about 0.15 mm to about 1.7 mm comprising a combination of:

a) microclusters of submicron crystallites of an aluminosilicate ion exchange material selected from the group consisting of zeolite A, zeolite X, zeolite Y, chabazite and mixtures thereof; and b) an anionic surfactant selected from the group consisting of linear and midchain branched alkyl sulfates, alkyl alkoxy sulfates, alkyl benzene sulfonates and mixtures thereof.

* * * * *